United States Patent [19]

Taguchi

[11] 4,122,915

[45] Oct. 31, 1978

[54] SOUND ABSORBING AND DIFFUSING UNIT, AN ACOUSTIC SCREEN AND/OR A PARTITION

[76] Inventor: Kazunori Taguchi, 6-8, Sakanoshita, Kamakura City, Kanagawa Prefecture, Japan

[21] Appl. No.: 701,016

[22] Filed: Jun. 30, 1976

[30] Foreign Application Priority Data

Jun. 30, 1975 [JP] Japan ..... 50-81296
Jul. 12, 1975 [JP] Japan ..... 50-96921[U]

[51] Int. Cl.[2] ..... E04B 1/99

[52] U.S. Cl. ..... 181/284; 181/210; 181/285; 181/286; 181/295; 428/33

[58] Field of Search ..... 181/285, 286, 284, 293, 181/295, 210, 175; 52/144; 428/33, 53, 133

[56] References Cited

U.S. PATENT DOCUMENTS

| | | | |
|---|---|---|---|
| 1,158,051 | 10/1915 | Hopkinson | 428/53 |
| 2,280,631 | 4/1942 | Coffey | 181/293 |
| 2,324,706 | 7/1943 | Jacobson | 181/285 |
| 2,595,047 | 4/1952 | Beranek | 181/286 |
| 3,077,426 | 2/1963 | Johnston | 181/286 |

*Primary Examiner*—Stephen J. Tomsky
*Attorney, Agent, or Firm*—Armstrong, Nikaido, Marmelstein & Kubovcik

[57] ABSTRACT

The sound absorbing and diffusing unit is provided for assembling an acoustic screen which can be placed in front of a wall inside an acoustic room for improving a sound effect therein. These units are detachably joined together with each other so that they can be easily separated and assembled again to form an acoustic screen or partition having another shape or construction to adjust or modulate a sound effect. A decorative sound absorbing porous panel having a desired picture or pattern can be easily hung against a wall. The decorative panel can be reversely hung on the wall to provide another interior ornamention. Accordingly, an acoustically correct room and a desired ornamentation on a wall inside the acoustic room can be easily obtained and changed without providing a rigid reverberating surface of the room.

2 Claims, 19 Drawing Figures

SOUND ABSORBING AND DIFFUSING UNIT, AN ACOUSTIC SCREEN AND/OR A PARTITION

FIELD OF THE INVENTION

This invention relates in general to a sound absorbing and diffusing unit, an acoustic screen and/or a partition assembling of said units, and more particularly to a sound absorbing and diffusing unit, an acoustic screen and/or a partition assembling of said units mounted in a sound-effects studio, an auditory room or a music hall for improving a sound effect and also for providing an interior ornamentation therein.

DESCRIPTION OF THE PRIOR ART

There have been various devices designed for improving an acoustic characteristic or a sound effect in a sound-effects studio, an auditory room or a music hall to obtain an acoustically correct effect. In most cases, it depends on a sound characteristic of the rigid reverberating surfaces such as a ceiling, a floor or walls of a room or building. As shown in FIG. 1, the sound 1 is either absorbed into sound absorbing materials 2 or diffused off irregular surfaces 2 or polycylindrical structures in order to improve a sound effect. Nevertheless, an acoustical reverberation inside the room can not be fully lessened and said room is unlikely to be able to provide the acoustic comfort needed. In addition, it needs a complicated calculation for the acoustical treatment and also an improvement of a reverberating surface inside an acoustic room.

Accordingly, in order to improve the conventional reverberating surfaces such as a ceiling or a wall of a room or a building, it is necessary to entirely improve these rigid sound reflection surfaces, and its working is considerably difficult and expensive. Even if the reverberating surfaces are improved, it is not easy to make further change or modification for modulating and adjusting a sound effect, where necessary.

The principal object of this invention is to provide a sound absorbing and diffusing unit for detachably assembling an acoustic screen which can be easily placed in front of the rigid reverberating surfaces such as a ceiling, a floor or walls in a sound-effects studio, an auditory room or a music hall for improving a sound effect thereof.

Another object of this invention is to provide a sound absorbing and diffusing unit for assembling an acoustic screen whereby a sound effect can be easily adjusted or modulated without improving any area of the rigid reverberating surfaces.

Another object of this invention is to provide an acoustic screen, the number, location and angle of which can be easily changed to adjust or modulate an auditory effect.

Another object of this invention is to provide an acoustic screen assembling of a plurality of a sound absorbing and diffusing units, which can be easily moved or disassembled so as to modulate or adjust a sound effect inside a room or a building.

Another object of this invention is to provide an ornamental sound absorbing perforated panel having a desired picture or pattern on each side thereof to be hung against a wall with an air chamber behind said panel or suspended below a ceiling whereby a sound effect inside a room or a building can be easily adjusted or modulated.

Another object of this invention is to provide an ornamental sound absorbing perforated panel having a desired picture or pattern on each side thereof to be attached as an architectural ornaments on a wall or suspended below a ceiling whereby an interior appearance inside a room or surroundings can be readily changed.

Another object of this invention is to provide an ornamental sound absorbing and diffusing partition which can be easily moved to a desired place inside an acoustic room.

A further object of this invention resides in the easy and efficient method by which each unit is fabricated, in that, each unit may be readily joined together with each other or by a proper brace or a frame to form an acoustic screen or a partition.

A still further object of this invention is to provide a simple, practical and reliable construction that is economical to manufacture, easy to assemble and disassemble, and positive in its operation.

BRIEF DESCRIPTION OF DRAWINGS

These and other objects and advantages are obtained by the invention, which is described hereinbelow in connection with the accompanying drawings, wherein.

DESCRIPTION OF INVENTION IN RELATION TO DRAWINGS

Figure 1:
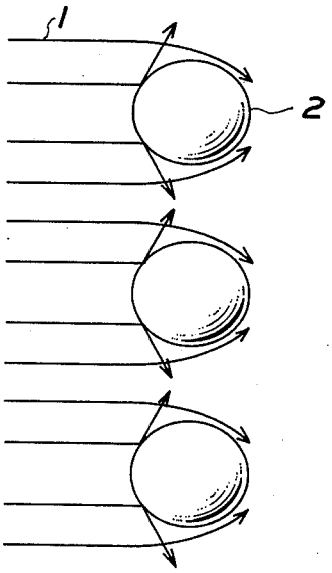
FIG. 1 PRIOR ART
FIG. 1 is a schematic drawing showing that some incident sounds are absorbed into an ellipsoidal sound absorbing unit and others are reflected off said unit.
Figure 2:
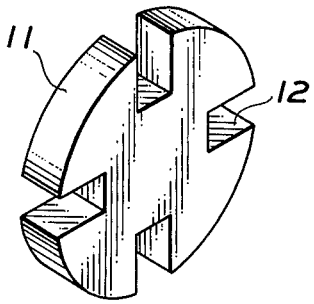
FIG. 2 is a perspective view of the first embodiment of the sound absorbing unit made in accordance with this invention.
Figure 3:
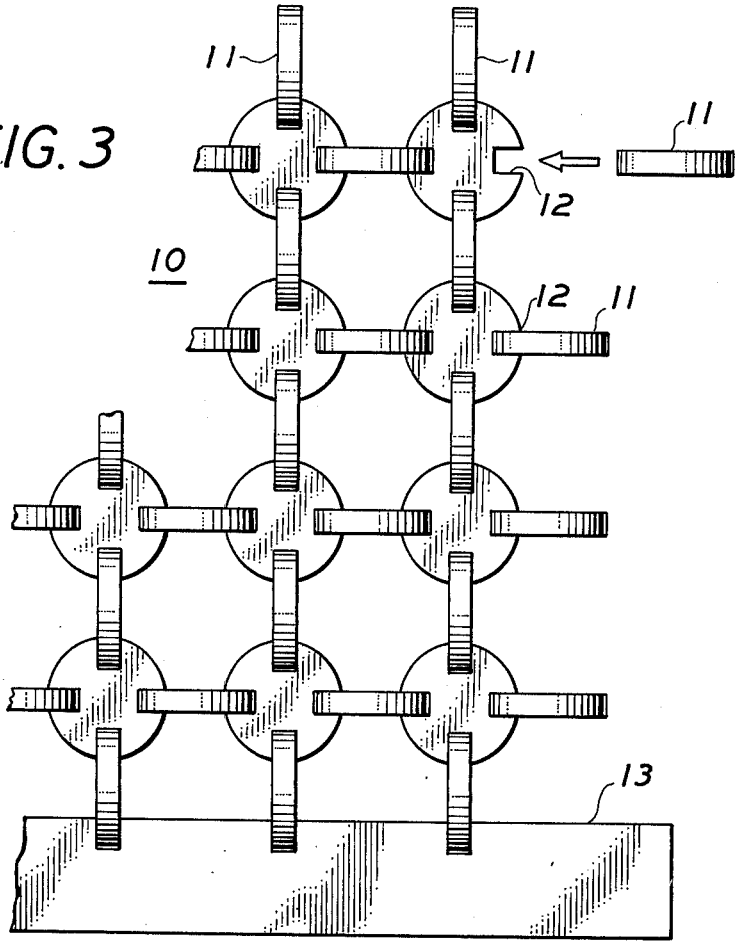
FIG. 3 is a partial front elevation of an acoustic screen assembling of a plurality of the sound absorbing units shown in FIG. 2.

Referring now to the accompanying drawings, and particularly to FIG. 2, there is shown the first embodiment of this invention. A disk-shaped porous sound absorbing and diffusing unit 11 made of material such as glass wool or rock wool having a diameter of about 30 cm. and also a regular thickness is provided with four cavities 12 crosswise around its circumference. A plurality of said porous units 11 are detachably joined together alternately at right angle with each other at their cavities 12 so as to form a plane or solid acoustic screen or partition 10 having a desired area, and said screen or partition may be fixed upright on a base 13. The acoustic screen 10 can be easily placed or stood in front of a wall or attached thereto to achieve acoustical comfort.

Figure 4:
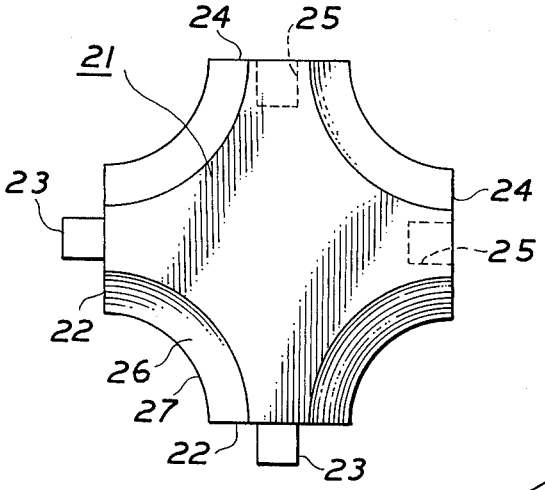
FIG. 4 is an front elevation of the second embodiment of another sound absorbing unit of this invention.
Figure 5:
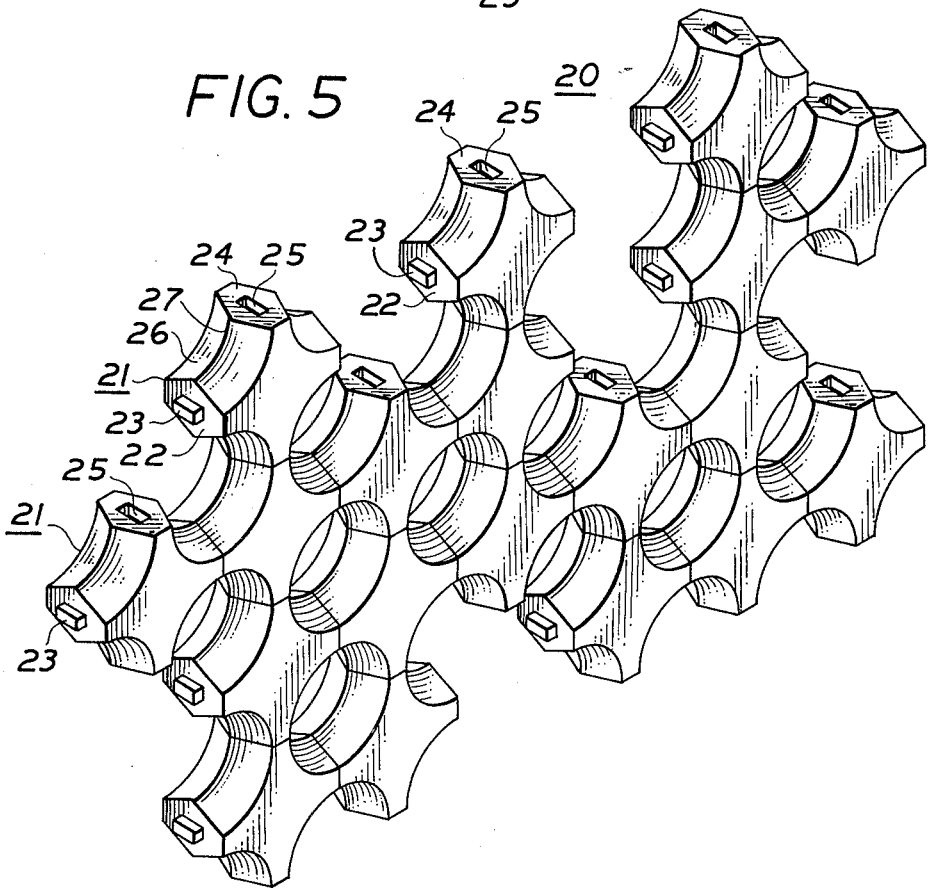
FIG. 5 is a partial perspective view of an acoustic screen assembling of a plurality of the sound absorbing units shown in FIG. 4.

As shown in FIG. 4, each apex of a diamond-shaped unit 21 made of sound absorbing material such as glass wool or rock wool is flattened and each arc-shaped side 26 of a diamond-shaped disc 21 having flattened apexes 22, 22 and 24, 24 is formed into a ridge 27 to facilitate an easy penetration of the sound into said unit. A projection 23 is radially provided on two neighboring apexes 22 each respectively, while a cavity 25 is radially formed into other neighboring apexes 24 each respectively for receiving corresponding projections 23. A number of the diamond-shaped sound absorbing disks 21 are combined with each other by inserting projections 23 into cavities 25 of the corresponding disc 21 so that a plane acoustic screen or partition 20 as shown in FIG. 5 can be formed, which can be stood in front of the wall or attached thereto like the foregoing screen 10.

Figure 6:
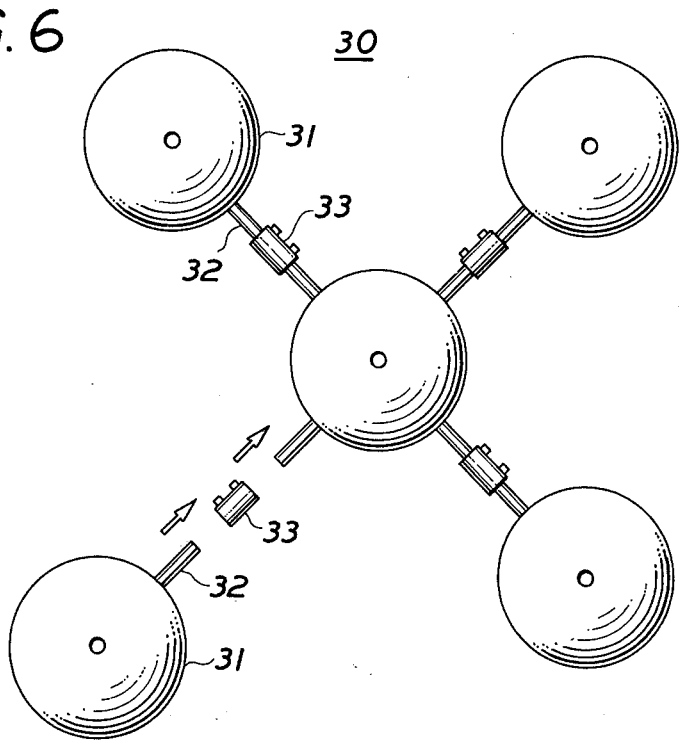
FIG. 6 is a schematic elevation illustrating the third embodiment of spherical sound absorbing units assembled into an acoustic screen.

In FIG. 6, there is shown the third embodiment of this invention, that is, a spherical sound absorber 31 made of sound absorbing material such as glass wool or rock wool is provided with pins 32 projecting crosswise and radially from the center of the absorber 31. These spherical sound absorber 31 are associated with each other by inserting pins 32 into sockets 33 to form an acoustic screen 30.

Figure 7:
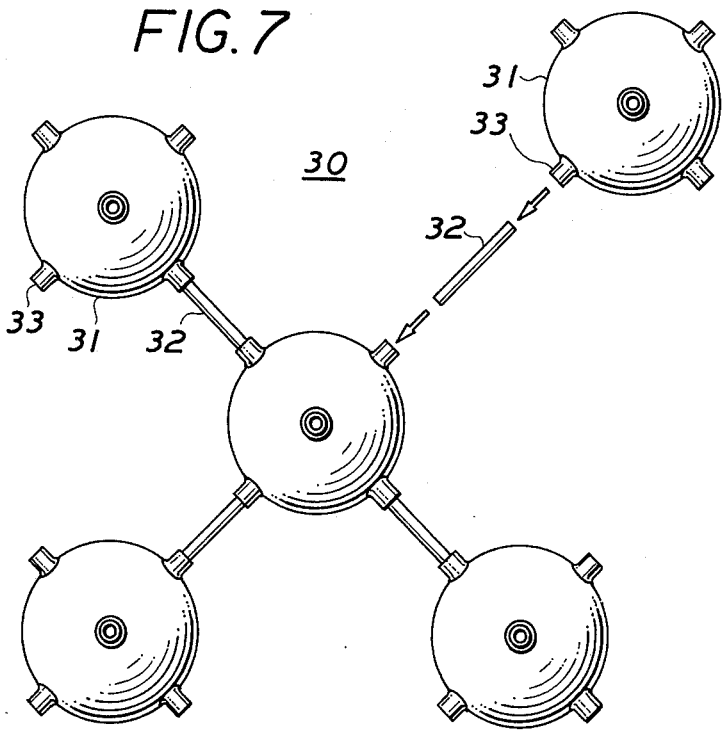
FIG. 7 is a similar schematic elevation of a modified form of the device shown in FIG. 6.
Figure 8:
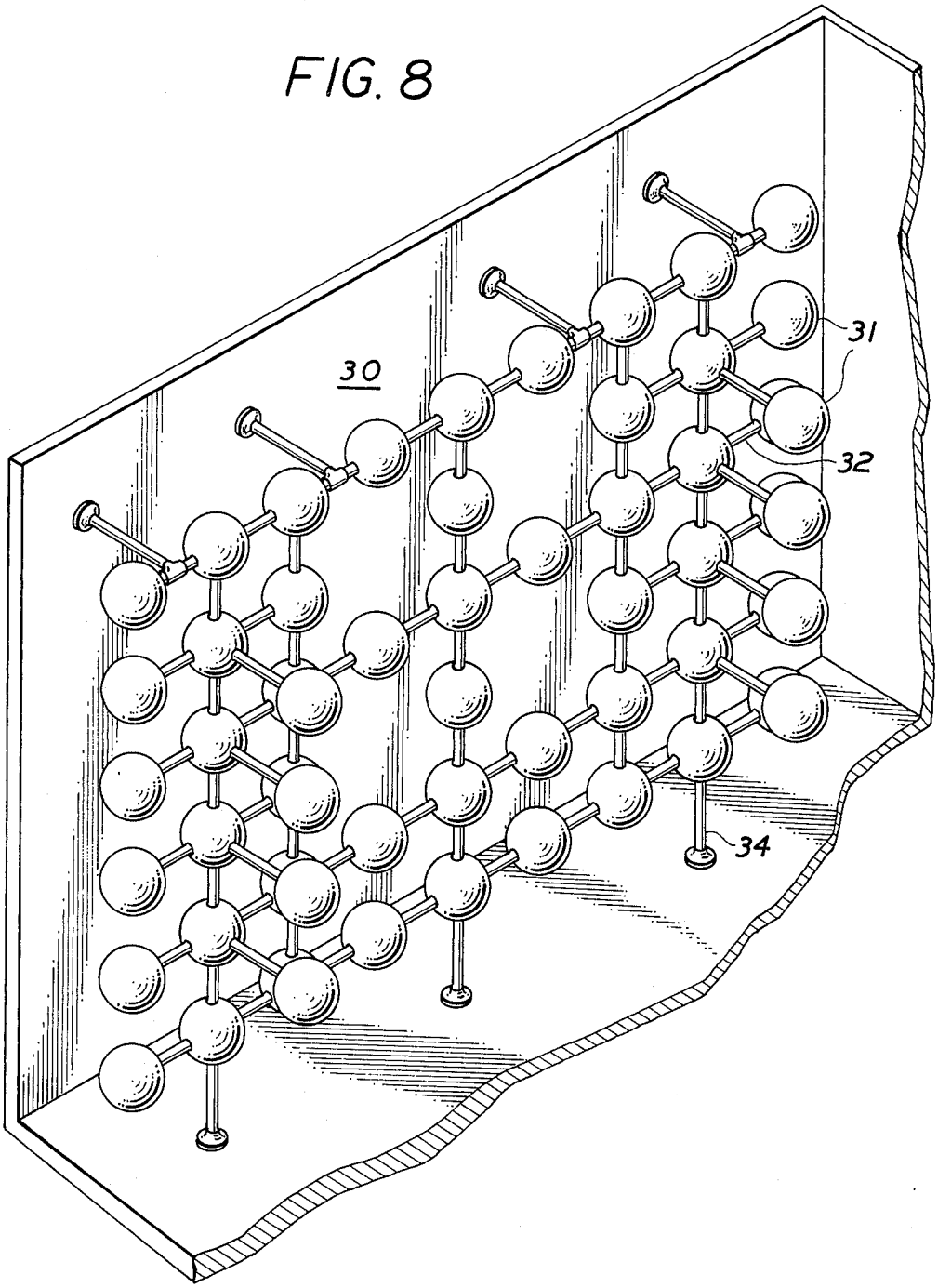
FIG. 8 is a perspective view of an acoustic screen assembling of the sound absorbing units shown in FIGS. 6 and 7 and mounted in front of a wall inside an auditory room.

As shown in FIG. 7, a plurality of the spherical sound absorbers 31 may be similarly associated with each other by inserting pins 32 into sockets 33 embedded into the absorbers 31 so that the acoustic screen 30 may be constituted. The acoustic screen 30 can be mounted in front of a wall inside an auditory room or a music hall by braces, pipes, frames or stands as shown in FIG. 8.

Figure 9:
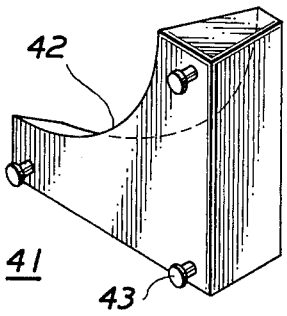
FIG. 9 is a rear perspective view of the fourth embodiment of the sound absorbing unit of this invention.
Figure 10:
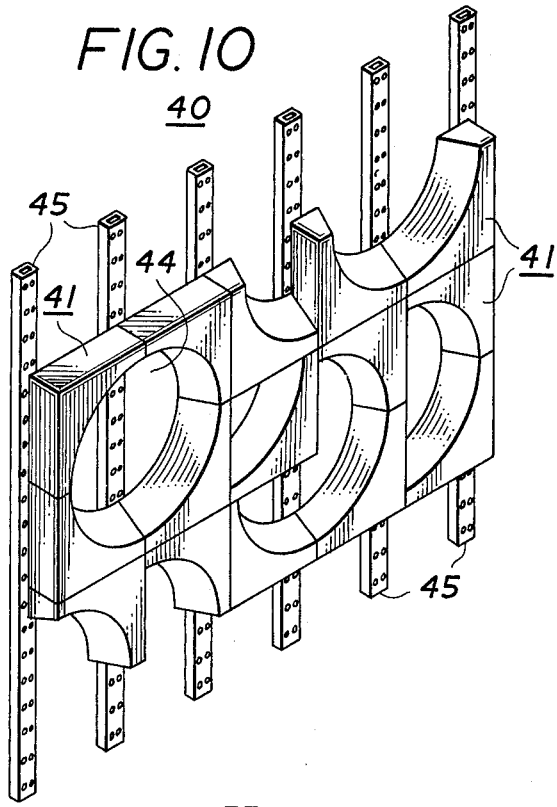
FIG. 10 is a partial perspective view of an acoustic screen assembling of a plurality of the sound absorbing units shown in FIG. 9.

A quarter cut sound absorbing panel 41 having a quarter cut opening 42 is provided with several fittings 43 on a rear side thereof (FIG. 9). In FIG. 10, these panels 41 are detachably attached by fittings 43 onto braces or frames 45 which are mounted vertically in front of a wall in such a way that a circular opening 44 may be formed to allow penetration of the sound and also to form an ornamental design, thus constituting a sound absorbing and diffusing screen or partition 40. Alternately, lower ends of braces 45 may be stood upright on a self-supporting stand (not shown), which can be placed with a regular interval to and in front of the wall.

Figure 11:
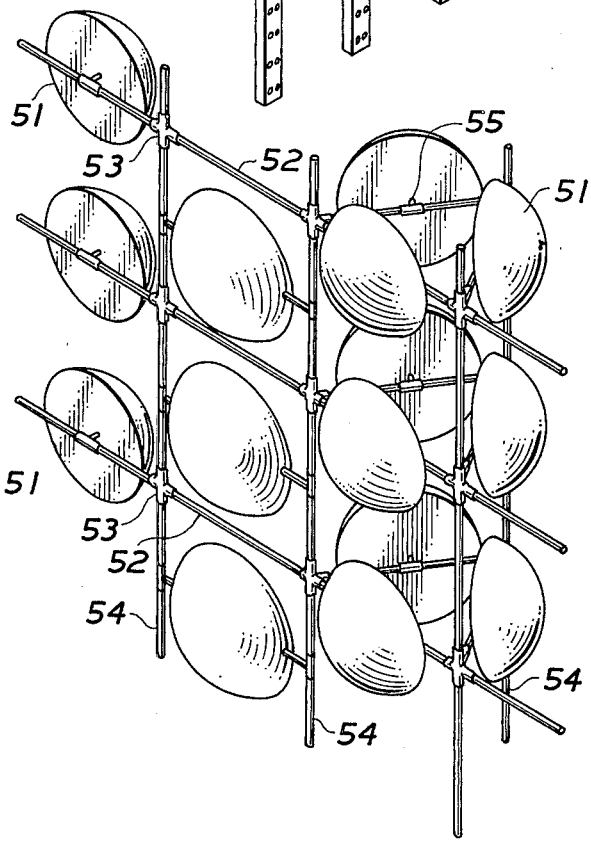
FIG. 11 is a partial rear perspective view of a modified form of the acoustic screen shown in FIG. 10.

In FIG. 11, pipes 52 are vertically and horizontally combined by fittings 53 to form a self-supporting frame 54 having square openings, and a plurality of semi-spherical sound absorbers 51 are fixed to the pipes 52 in such a manner that each absorber may occupy each square opening substantially. In this way, the acoustic screen 50 thus constituted can be arranged in front of the wall with an air chamber behind said screen.

Figure 12:
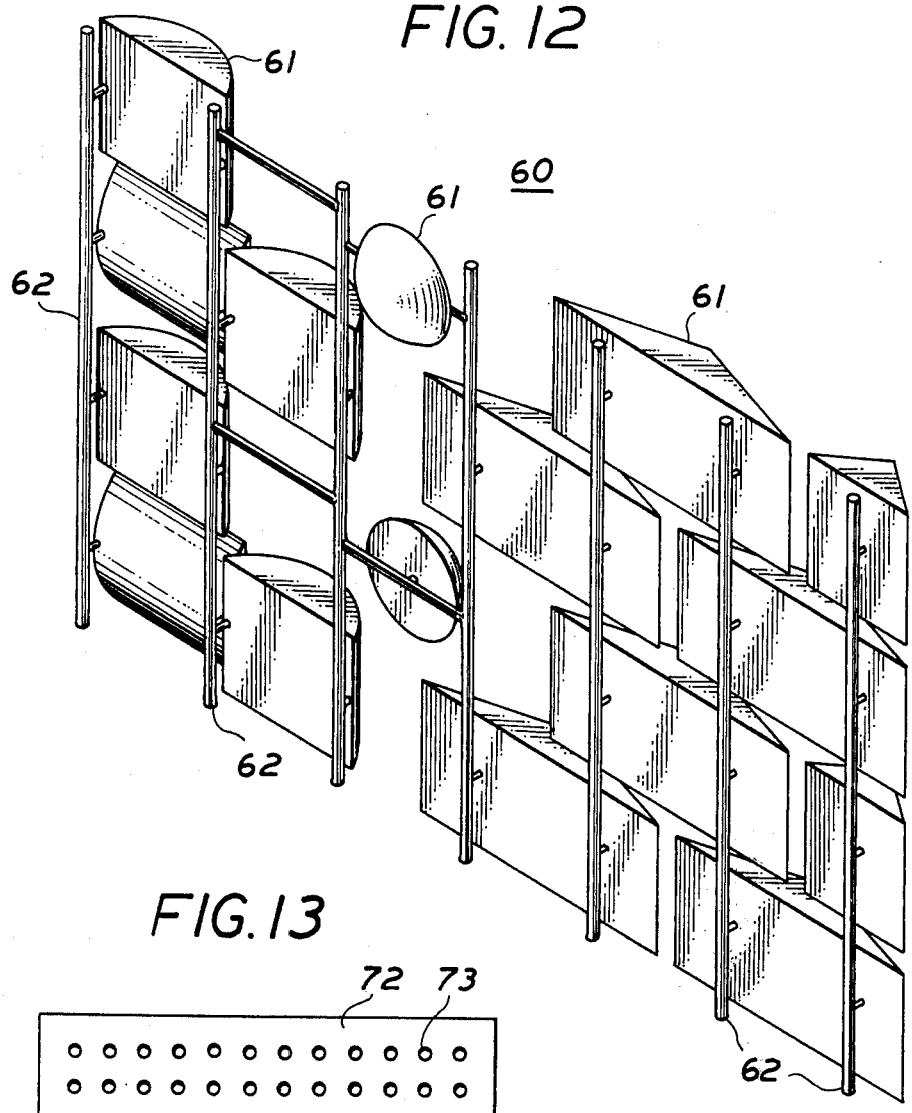
FIG. 12 is a similar rear perspective view of still a further modification.

FIG. 12 shows another acoustic screen 60 consisting of a plurality of pipes 62 arranged parallely, vertically and combined with a number of various sound absorbers 61 such as semi-cylindrical, semi-spherical, ones.

In the embodiments shown in FIGS. 6 - 12, various units made of sound absoring material having a suitable hardness are fixed to the pipes, braces or frames by fittings, couplings or sockets.

In case of using soft or low density sound absorbing material, it is possible to carry out a simultaneous molding by applying said soft material around the fittings or couplings. Alternately, the soft sound absorbing material can be filled into a porous shell or frame having mesh or grid openings and each surface is covered with a clothing to form a complicated construction exhibiting effective sound diffusion.

When a sound resonating shell is used together with a sound reverberating unit and also with lighting fixtures, more comfortable acoustic effect and interior ornamentation can be obtained.

Figure 13:
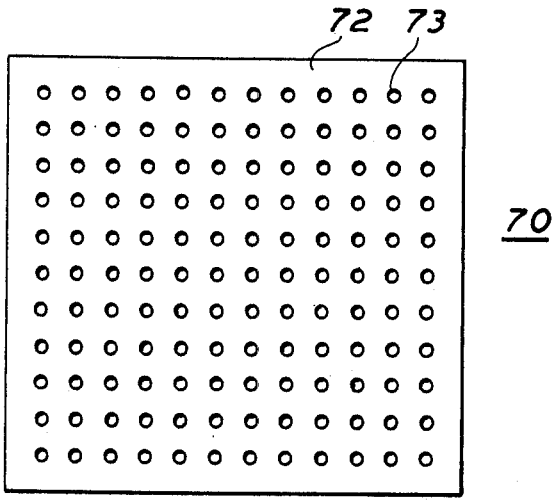
FIG. 13 is a schematic front elevation of the fifth embodiment of an ornamental sound absorbing panel of this invention.
Figure 14:
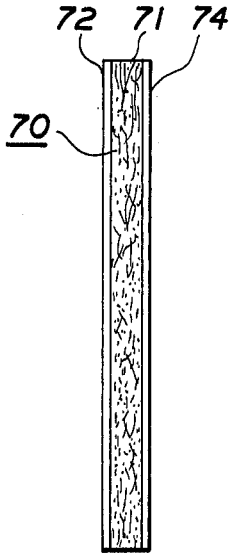
FIG. 14 is a side elevation of the panel shown in FIG. 13.
Figure 15:
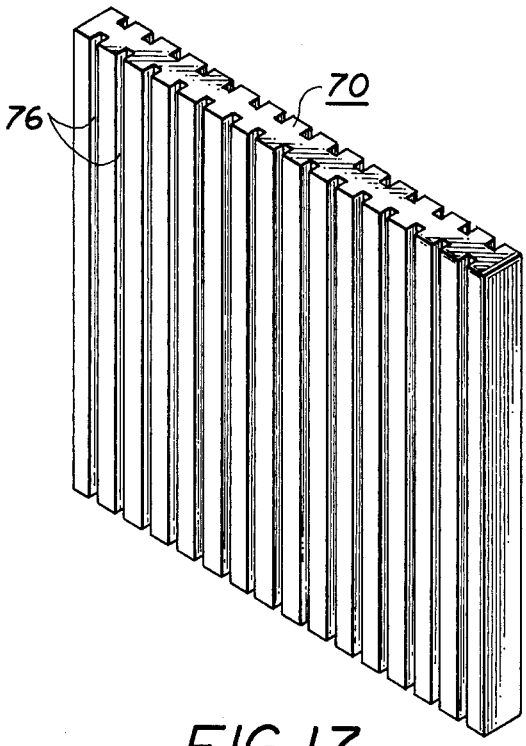
FIG. 15 is a perspective view of a modified form of the ornamental sound absorbing panel of this invention.

Referring to FIGS. 13 and 14, a layer of sound absorbing material 71 made of glass wool, rock wool or sponge having a regular thickness is integrally put between a pair of panels 72, 74 having a number of small openings 73, 75 respectively to constitute a sound absorbing panel 70. A desired picture or pattern may be drawn on each face of these panels 72 and 74. These decorative porous panels may be wood, plywood, plaster, cement boards or light metal such as aluminium board. Otherwise, these panels may be integrally covered with a proper clothing having a desired picture or pattern thereon. As shown in FIG. 15, the panels 72, 74 may be provided with parallel slits 76 at regular intervals instead of small openings 73, 75 or the panel may be changed with a perforated plate having a relief thereon.

Figure 16:
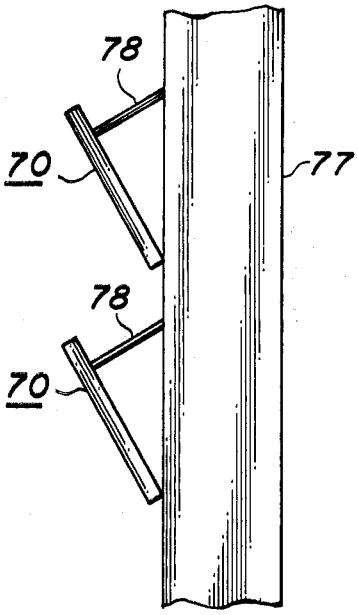
FIG. 16 is a schematic side elevation illustrating that the ornamental panels shown in FIGS. 13, 14 and 15 are hung against a wall.
Figure 17:
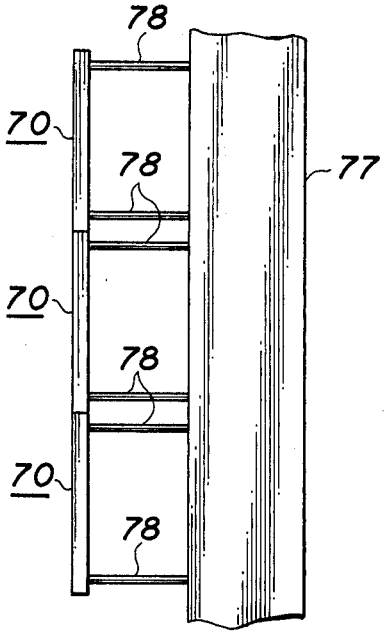
FIG. 17 is a similar side elevation of the ornamental panels attached on a wall.
Figure 18:
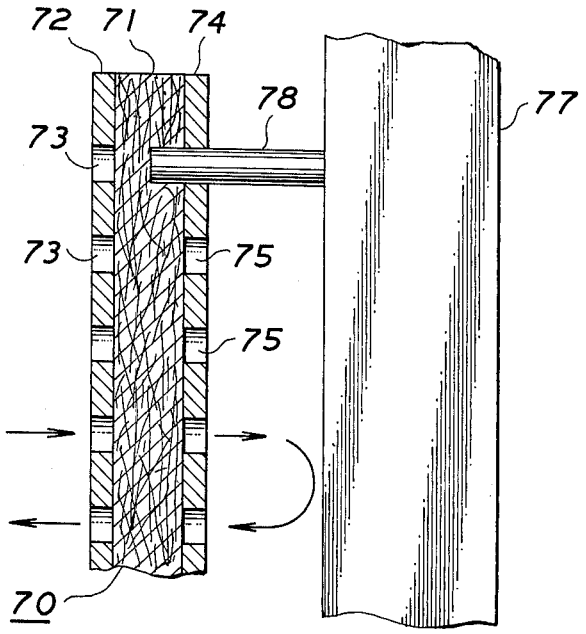
FIG. 18 is an enlarged vertical section of a part of the panel shown in FIG. 17.

In FIGS. 16, 17 and 18, the sound absorbing panels 70 are hung against a wall 77 by fittings 78 with an air chamber behind, or the panels may be reversely hung to show another ornamentation.

As particularly seen in FIG. 18, most of the incident sound penetrate through the panel 70 and get lost in an air chamber behind and the remaining sound reverberated off the wall 77 is absorbed again when passing through the panel 70, thus improving an acoustic effect.

Figure 19:
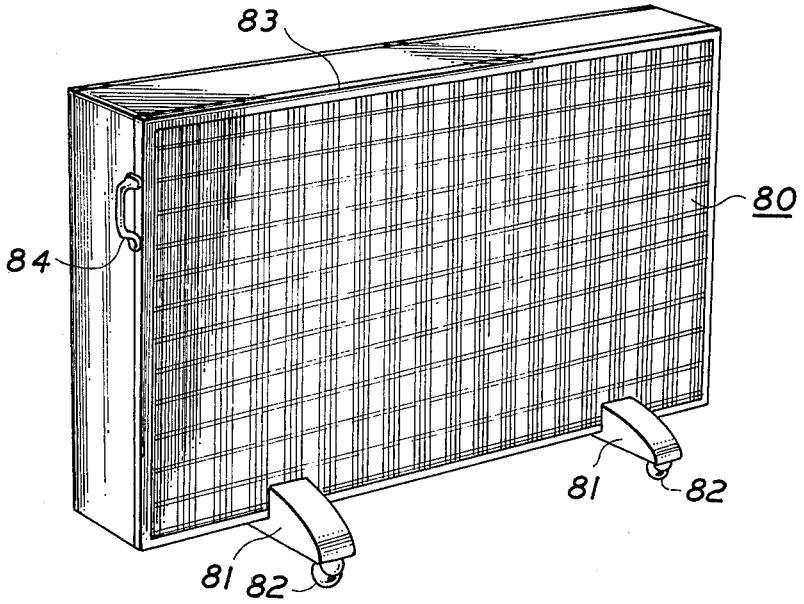
FIG. 19 is a perspective view of a movable acoustic partition of this invention.

In FIG. 19, a decorative sound absorbing panel 80 is provided with a handle 84 on its one side 83 and a pair of bases 81 and 81, each having four casters 82 respectively so that a movable acoustic partition or screen may be obtained.

As explained in the foregoing paragraphs, it can be seen that the number, location and angle of the sound absorbing and diffusing units of this invention can be easily changed by disassembling the units and joining them again into another construction so that the sound absorbing and diffusing effects can be readily modulated or adjusted as desired. Consequently, it enables the adopting of a sound absorbing and diffusing unit having a given absorption coefficient and diffusion coefficient and also it is possible to use the absorbing and diffusing unit having any construction, size or material. In accordance with this invention, it facilitates the obtaining of a desired acoustically correct room by assembling the units into an acoustic screen or a partition, to modulate the acoustic effects by improving the assembly and by moving said screen into a desired place within the room and also to mount said screen by a fitting, brace, frame, arm, wire, etc.

In accordance with this invention, it should not become apparent to one skilled in the art that numerous other embodiments and modifications thereof are contemplated as falling within the scope of this invention. The scope of this invention shall be interpreted by the following claims.

What I claim is:

1. A sound absorbing and diffusing unit made of porous sound absorbing material, formed as a square having an arc-shaped cut out at each corner with a flat apex portion at each side, each arc-shaped portion tapered to form a ridge, wherein each apex of said unit is flattened, each arc-shaped side of said unit is formed into a ridge, a projection is radially provided on two neighboring apexes each respectively and a cavity is radially formed into two other neighboring apexes each respectively.

2. An acoustic screen as claimed in claim 1, which is assembled from a plurality of units, wherein two projections are integrally inserted into cavities of corresponding units.

* * * * *